US007226492B2

(12) United States Patent
Mahot et al.

(10) Patent No.: US 7,226,492 B2
(45) Date of Patent: Jun. 5, 2007

(54) HIGH-POWDER TUNGSTEN-BASED SINTERED ALLOY

(76) Inventors: Pascal Mahot, 7, rue du Leman, Saint Julien en Genevois (FR) 74160; Guy Nicolas, 246, clos du May, Eteaux (FR) 74800; Marc Voltz, Les Fontaines, Chatillon/Cluses (FR) 74300

( * ) Notice: Subject to any disclaimer, the term of this patent is extended or adjusted under 35 U.S.C. 154(b) by 54 days.

(21) Appl. No.: 10/490,962

(22) PCT Filed: Sep. 20, 2002

(86) PCT No.: PCT/FR02/03229

§ 371 (c)(1),
(2), (4) Date: Jan. 3, 2005

(87) PCT Pub. No.: WO03/027340

PCT Pub. Date: Apr. 3, 2003

(65) Prior Publication Data

US 2005/0103158 A1 May 19, 2005

(30) Foreign Application Priority Data

Sep. 26, 2001 (FR) ..... 01 12376

(51) Int. Cl.
*B22F 3/12* (2006.01)
*C22C 27/04* (2006.01)
*F42B 12/72* (2006.01)

(52) U.S. Cl. ..... 75/248; 102/517; 419/46; 419/47; 419/54; 419/58

(58) Field of Classification Search ..... 75/248; 419/46, 47, 54, 58; 102/517
See application file for complete search history.

(56) References Cited

U.S. PATENT DOCUMENTS

| | | | | |
|---|---|---|---|---|
| 3,888,638 | A | 6/1975 | Sczerzenle et al. | 29/182 |
| 4,090,875 | A * | 5/1978 | Ludwig | 75/248 |
| 4,698,096 | A | 10/1987 | Schmidberger et al. | 75/248 |
| 4,801,330 | A | 1/1989 | Bose et al. | 75/298 |
| 4,938,799 | A | 7/1990 | Nicolas | 75/248 |
| 5,740,516 | A * | 4/1998 | Jiranek et al. | 428/553 |
| 5,760,378 | A | 6/1998 | Christian et al. | 219/603 |
| 5,821,441 | A | 10/1998 | Kawamura | 75/248 |
| 5,863,492 | A * | 1/1999 | Bose | 420/430 |
| 5,956,558 | A * | 9/1999 | Hong et al. | 419/27 |
| 5,956,559 | A * | 9/1999 | Song et al. | 419/29 |
| 6,277,326 | B1 * | 8/2001 | Vecchio et al. | 419/47 |

FOREIGN PATENT DOCUMENTS

| | | |
|---|---|---|
| EP | 0 323 628 | 7/1989 |
| EP | 0 355 181 | 2/1990 |
| JP | 3-173727 | 7/1991 |

* cited by examiner

*Primary Examiner*—Ngoclan T. Mai
(74) *Attorney, Agent, or Firm*—Steptoe & Johnson LLP

(57) ABSTRACT

Tungsten-based alloy material sintered at a high sintering power that may contain additive elements soluble in the nickel and selected from the group constituted, for example, by rhenium, molybdenum, tantalum, niobium, vanadium or a mixture of these, wherein, after sintering in liquid phase at a temperature of around 1500° C., it has:

a two-phased $\alpha$-$\gamma$ microstructure that is fully densified, has no porosities or has negligible porosities of a low mean grain size ($L\alpha$) and a contiguity ($C\alpha\alpha$) that is very low with respect to the size of the tungsten crystals, and a dispersion of micro-oxides with no loss of ductility properties.

13 Claims, 9 Drawing Sheets

HIGH-POWDER TUNGSTEN-BASED SINTERED ALLOY

BACKGROUND OF THE INVENTION

The technical scope of the present invention is that of tungsten-based alloy sintered materials.

By tungsten-based alloys we mean alloys mainly enclosing tungsten associated with nickel, iron and cobalt, or nickel and manganese, or nickel and chromium, or nickel and iron and including such additive elements as rhenium, molybdenum, niobium, vanadium, tantalum, or a mixture of these.

The usual manufacturing process for a sintered material from alloys based on W—Ni (Fe, Co, Cr, Cu, Mn), that may contain other additive elements such as rhenium or molybdenum, more often than not consists in sintering, in the liquid phase, in through-type furnaces or static furnaces, with heating by radiation, for a processing time of several hours. Alloys based on systems such as W—Ni—Fe—Co, W—Ni—Co, W—Ni—Cu, W—Ni—Cr or W—Ni—Mn are thus industrially prepared in this manner.

In a known manner, sintering cycles incorporate three main stages:

- a rise in temperature of the ambient to around 1450/1600° C. over a time lapse of 2 h to 5 h
- followed by a holding time more often than not in the 1450/1600° C. temperature range of around 15 to 45 minutes but which may extend to a few hours (<10 h),
- and, at the end of the cycle, a cooling phase until reaching an ambient temperature of around 30 mn to 3 h, this in a reducing atmosphere ($H_2$), or even under vacuum.

Such temperature cycles, when sintering W-based alloy materials in liquid phase, lead to products that are generally two-phased (crystals α (w) surrounded by a phase γ), with no porosities, and having specific physical and mechanical properties depending on the basic chemistry and the microstructure.

It is well known to the expert that processes using sources of energy such as the laser by heat radiation, electromagnetic induction, microwaves by magnetic field effect enable the temperature of certain metals to be raised, with heavy thermal power dissipation.

With respect to the heating means, many publications describe the possibility of using heating means such as induction or microwaves to sinter metallic or ceramic powders, and notably tungsten carbides.

The article by Messrs HERMEL, KRUMPHOLD, LEITNER published in 1982 in the review, High Temperature—High Pressures (1982, volume 14, pages 351–356) presents the results of sintering by induction of carbide materials WC—Co and WC—TiC—Co. These works have enabled sintering times to be considerably reduced for carbides and preparation conditions to be defined that take into account a preheating stage of 5 to 15 mn followed by sintering of 2 to 8 mn in the 1520/1590° C. temperature range. These works were then extended to iron-based materials, as published by the same authors in the Proceeding of the Third International School on Sintered Materials in 1984.

Reference may equally be made to the article published by Mr UYGUR in 1985, also in the Proceeding of the Third International School on Sintered Materials (pages 303–322) which also deals with the preparation of carbides and ceramics by induction. For carbides, the sintering temperature range is of 1440/1550° C. for 40 to 120 mn. For ceramics, it is of 1150/1800° C. for 30 to 60 mn.

More recently, in June 2000, the works of Dr AGROWAL's team from Pennsylvania University, concerning microwave sintering, were published on the Internet (on site www.reasearch.psu.edu/iro/html/metalparts.htm). This article specifies that metallic powders such as tungsten and tungsten carbide may be sintered by microwave in 10 to 30 mn. We note that, if this process allows a homogeneous structure to be obtained, it nevertheless leads to the presence of fine porosities.

The different results described above demonstrate, therefore, that processes other than blast furnace sintering by thermal radiation may be used to densify powders whilst reducing sintering time.

However, we also note that the works mentioned above and published about induction essentially relate to tungsten carbides and the works performed on microwaves relate mainly to metallic powders, with at the end of the consolidation process, a structure that is not fully densified and which has porosities.

Furthermore, these processes have never been applied to tungsten-based alloys with a preparation in the liquid phase since the expert was more inclined to think that this process gave results that were at best only equivalent to those obtained by classical processes. Moreover, tungsten-based alloys only represent a very small share of the tungsten market despite their producing very interesting performances.

This is why the applicant studied the application of this technology for liquid phase materials in the aim of reducing sintering times and minimising product deformations because of the liquid phase. The different techniques and high-power heating means allowing high power to be delivered in a short time, such as the laser, induction, microwaves, have been studied. By high power, we mean heating able to reach a temperature of around 1500° C. in a very short time, for example less than 30 mn.

This being said, these techniques, once applied to the sintering of tungsten alloys and at critical powers, have been observed to produce totally original microstructures, which may or not be accompanied by a level of mechanical properties up to now unattained for such alloys in liquid phase.

SUMMARY OF THE INVENTION

The aim of the invention is thus to propose a sintered material and a preparation process implementing high power sintering conditions allowing tungsten-based alloys to be sintered in a short time and a fully densified material, such as that obtained at the end of a conventional sintering operation by thermal radiation, to be produced.

A further aim of the present invention is to additionally obtain, using specific heating powers, tungsten-based alloys, which at the end of the sintering cycle has low grain-sized microstructures and very low contiguity between the tungsten crystals.

The invention thus relates to a tungsten-based alloy material sintered at a high sintering power that may contain additive elements soluble in the nickel and selected from the group constituted, for example, by rhenium, molybdenum, tantalum, niobium, vanadium or a mixture of these, wherein, after sintering in liquid phase at a temperature of around 1500° C., it has:

- a two-phased α-γ microstructure that is fully densified, has no porosities or has negligible porosities of a low mean grain size (Lα) and a contiguity (Cαα) that is very low with respect to the size of the tungsten crystals, and a dispersion of micro-oxides with no loss of ductility properties.

Advantageously, the percentage in mass of tungsten is of between 85 and 97% and preferentially 90.5 and 93.5%.

Advantageously again, the material is of the following composition: 93% tungsten, 4.05% nickel, 1% iron and 1.95% cobalt, with a relative density of 100%.

Advantageously again, the material is of the following composition: 91% tungsten, 6.2% nickel, 0.3% iron and 2.5% cobalt, with a relative density of 100%.

Advantageously again, the material is of the following composition: 91% tungsten, 6% nickel and 3% cobalt, with a relative density of 100%.

Advantageously again, the material is of the following composition: 92.95% tungsten, 5% nickel, 2% copper and 0.05% manganese, with a relative density of 100%.

The invention also relates to a preparation process of a tungsten-based alloy according to one of the above, wherein a mixture of metal powders is made, which is then compressed at a pressure of around $2.10^8$ Pa, then high power sintered in a liquid phase at a heating temperature of around 1500° C., the time to reach said temperature taking less than 15 mn, a heating power raising the temperature by at least 100° C./mn for a holding time of less than 15 mn, to obtain a total densification and a structure with no porosities following a full cycle of less than 25 mn.

Advantageously, the heating power is obtained by induction in a neutral gas, such as nitrogen or argon.

Before sintering, a deoxidisation is carried out in $H_2$ at T>1300° C. to obtain full densification after sintering accompanied by a structure with no dispersion of oxide.

The invention also relates to the manufacture of penetrators for ammunition or to tool holders.

Remarkably, with alloys from W—Ni—Fe—Co and W—Ni—Co systems, the invention leads to materials whose mechanical properties provide a resistance-ductility trade-off that is better than that obtained using conventional sintering conditions.

The invention enables tungsten-based materials to be obtained that are more usually than not of a density greater than 16 to 18.5 g/cm$^3$ and which present the following specificities:

being sintered at a very high power level, with a total cycle time less than 25 mn and a sintering time in the liquid phase of less than 10 mn, leading to a fully densified structure, more often than not without porosities, enable microstructures having very small grain size (Lα≦12 μm) to be obtained, enable two-phased tungsten-based alloys to be prepared by sintering in a neutral, non reducing, gas, such as nitrogen or argon, leading to a dispersion of micro-oxides with no loss of ductility, enable a structure containing no micro-oxides to be obtained, on condition that a deoxidisation process is performed beforehand in $H_2$ at a temperature substantially over 1100° C.

BRIEF DESCRIPTION OF THE DRAWINGS

Other characteristics, particulars and advantages of the invention will become more apparent from the following additional description of the different embodiments of typical configurations, given by way of illustration in reference to the appended drawings, in which.

DETAILED DESCRIPTION OF PREFERRED EMBODIMENTS

Figure 1:
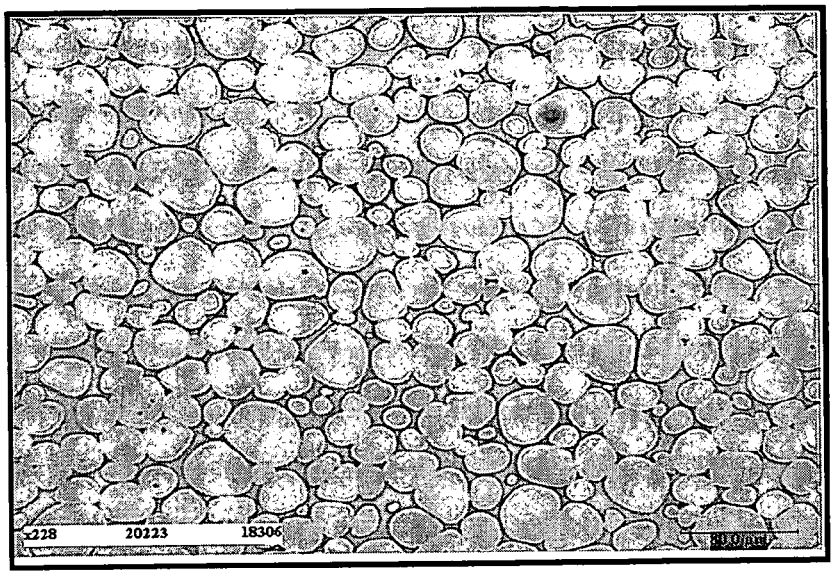
FIG. 1 shows a micrograph of the microstructures of a first tungsten-based material sintered according to prior art, that is to say in a conventional manner.

Note that the contribution of these new structural states is analysed after sintering and after a rolling and heat treatment operation which are standard stages in the preparation of such materials.

To highlight the materials and process according to the invention, a set of tungsten-based materials made using standard powder mixtures has been made, the tungsten-powder being micronic (2–6 μm) or submicronic (<1 μm), related to the three most generally used types of alloy: W—Ni—Fe—Co, W—Ni—Co and W—Ni—Cu—Mn.

Before sintering, the cylinders, of a diameter of between 10 and 23 mm for a length of 80 to 210 mm, are compressed at $2.10^8$ Pa. These cylinders are then put into a furnace and are subjected to a sintering operation such as that described hereafter.

Note that since sintering by LASER interaction is not well adapted to consolidation in volume; trials with electromagnetic induction were performed, in a neutral and/or slightly reducing atmosphere, mainly using nitrogen for reasons of cost.

For each alloy configuration, the high power sintering cycles were performed using firstly, compacts and secondly, compacts deoxidised by hydrogen treatment.

For the W—Ni—Fe—Co and W—Ni—Co alloys, a stage at 700° C. for 2 h and a stage at 1420° C. for 20 mn were adopted.

For the W—Ni—Cu—Mn alloys, a stage at 700° C. for 2 h and a stage at 1350° C. for 20 mn were adopted.

EXAMPLE 1

A bar is prepared from a W—Ni—Fe—Co alloy having the following composition in mass: tungsten 93%, nickel 4.05%, iron 1% and cobalt 1.95% which is then subjected to the sintering operation according to the invention:

density 17.6
geometry: cylinder Ø 10, L=90 mm,
compression: $2.10^8$ Pa
sintering by induction in $N_2$,
time to reach T max 1500° C.: <5 mn
temperature build-up rate: δT/δt~300° C./mn,
time at 1500° C. stage: 3 mn (sintering time at liquid phase: <3 mn 30 s).

The following characteristics are obtained:
relative density: 100% (theoretical d: 17.79)
porosity: none
On a microstructural level, we observe:

In FIG. 1, we see a bar having the same composition but sintered according to prior art which has the following characteristics: Vα=84.8%, Lα=20.1 μm, Cαα(%)=22.3%, λγ=3.6 μm.

Figure 2:
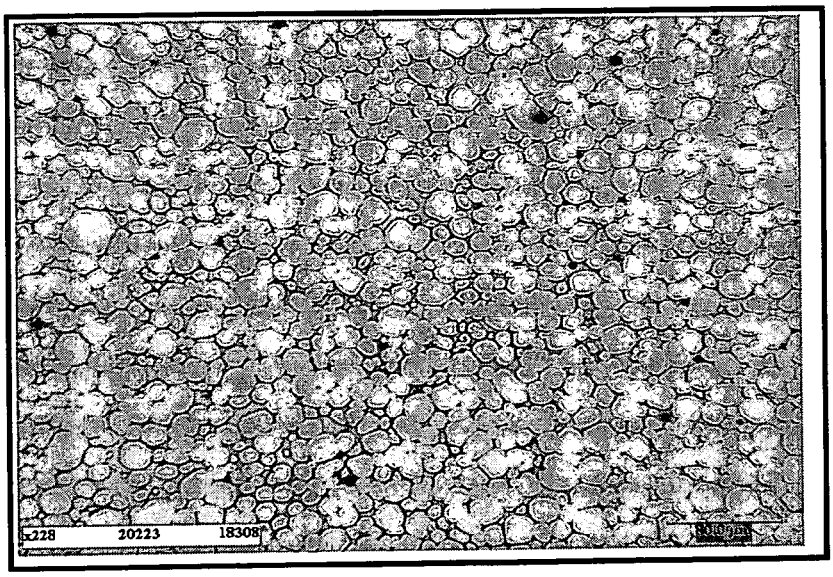
FIGS. 2 and 3 show micrographs of the microstructures of a first tungsten-based material sintered according to the invention.

In FIG. 2, which shows the micrograph of the material without any previous reduction processing, the material according to the invention and according to example 1 has the following characteristics: Vα=82%, Lα=9.6 μm, Cαα(%)=20.2%, λγ=2.0 μm.

Figure 3:
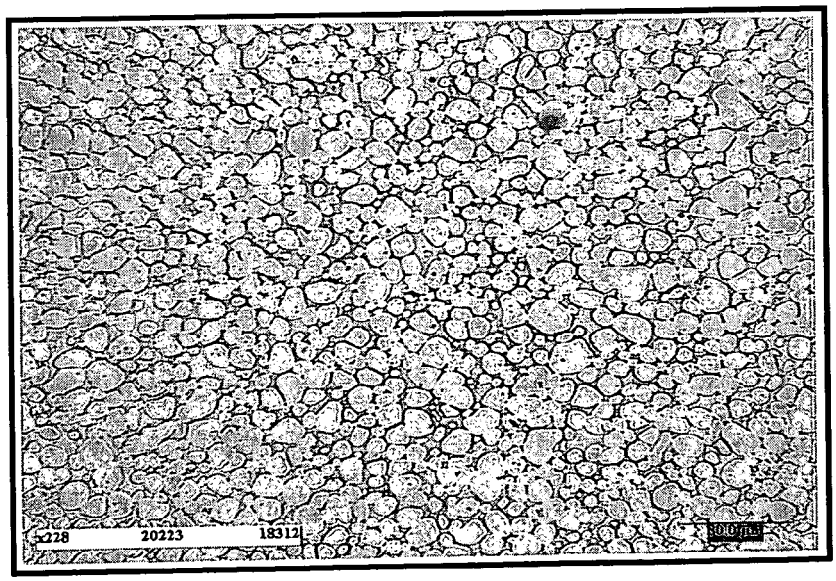

In FIG. 3, which shows the micrograph of the material having undergone reduction processing, the material according to example 1 has the following characteristics: Vα=82.4%, Lα=9.2 μm, Cαα(%)=18.2%, λγ=2.0 μm.

We observe therefore that with or without prior reduction processing, all of the morphology parameters have lower values and with an even lower reduction of the contiguity Cαα.

The process according to the invention thus enables all the morphology characteristics to be reduced for a material sintered using this process.

EXAMPLE 2

A bar is prepared from a W—Ni—Fe—Co alloy (91, 6.2, 0.3, 2.5%) having a density of 17.1 by processing in the liquid phase according to the invention as explained previously:

geometry: cylinder ø 10, L=90,
compression: $2.10^8$ Pa
sintering by induction in $N_2$ in the liquid phase,
time to reach T max 1500° C.: <5 mn
temperature build-up rate: δT/δt~400° C./mn,
time at 1500° C. stage: 3 mn (sintering time at liquid phase: <3 mn 30 s).

Figure 4:
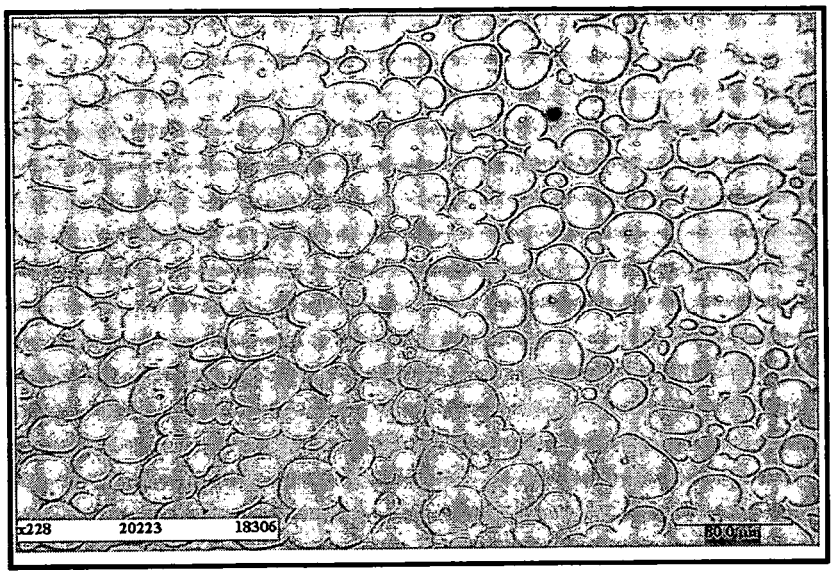
FIG. 4 shows a micrograph of the microstructures of a second tungsten-based material sintered conventionally according to prior art.

The following results are obtained:
relative density: 100% (theoretical d: 17.45)
porosity: none
On a microstructural level, we observe:

In FIG. 4, we see a bar having the same composition but sintered according to prior art which has the following characteristics: Vα=80.2%, Lα=20.0 μm, Cαα(%)=15%, λγ=4.9 μm.

Figure 5:
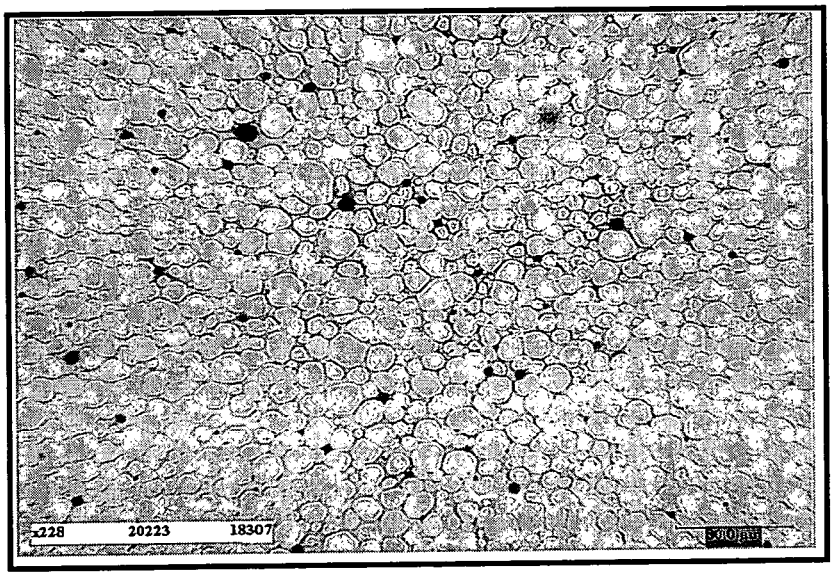
FIGS. 5 and 6 show micrographs of the microstructures of a second tungsten-based material sintered according to the invention.

In FIG. 5, which shows the micrograph of the material without any previous reduction processing, the material according to the invention and according to example 2 has the following characteristics: Vα=79.5%, Lα=9.9 μm, Cαα(%)=14%, λγ=2.6 μm.

Figure 6:
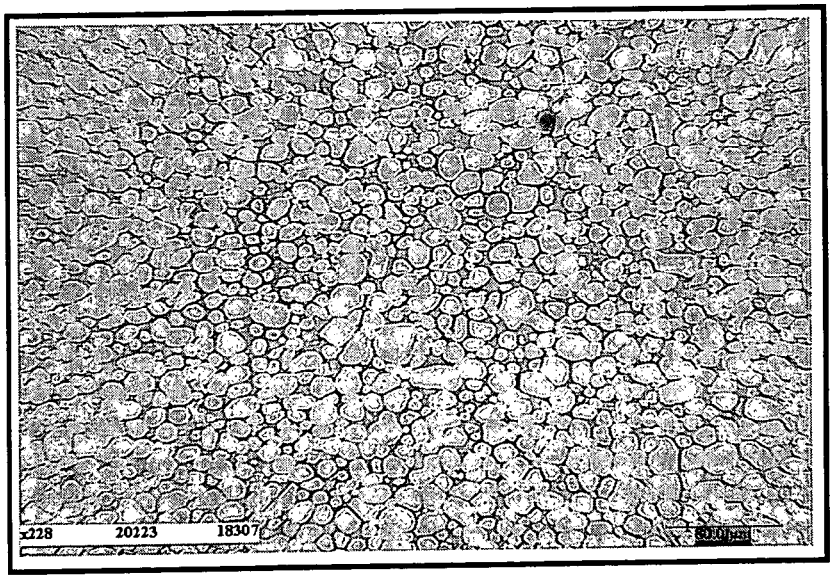

In FIG. 6, which shows the micrograph of the material having undergone reduction processing, the material according to example 2 has the following characteristics: Vα=78.5%, Lα=8.6 μm, Cαα(%)=13.5%, λγ=2.4 μm.

We observe therefore that with or without prior reduction processing, all of the morphology parameters have lower values and with an even lower reduction of the contiguity Cαα.

The process according to the invention thus enables all the morphology characteristics to be reduced for a material sintered using this process.

EXAMPLE 3

Figure 7:
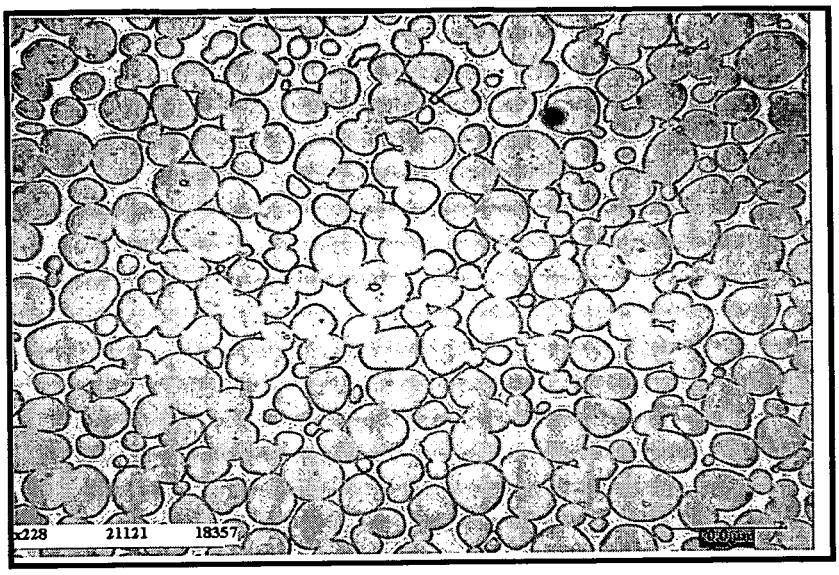
FIG. 7 shows a micrograph of the microstructures of a third tungsten-based material sintered conventionally according to prior art.

A bar is prepared from a W—Ni—Co alloy (91, 6, 3%) having a density of 17.5 by processing in the liquid phase according to the invention as explained previously:

geometry: cylinder ø 10, L=90,
compression: $2.10^8$ Pa
sintering by induction in $N_2$,
time to reach T max 1500° C.: <7 mn
temperature build-up rate: δT/δt~300° C./mn,
time at 1530° C. stage: 3 mn (sintering time at liquid phase: <3 mn 30 s).

relative density: 100% (theoretical d: 17.45)
porosity: none
On a microstructural level, we observe:

In FIG. 7, we see a bar having the same composition but sintered according to prior art which has the following characteristics: Vα=78%, Lα=19 μm, Cαα(%)=17.8%, λγ=5.4 μm.

Figure 8:
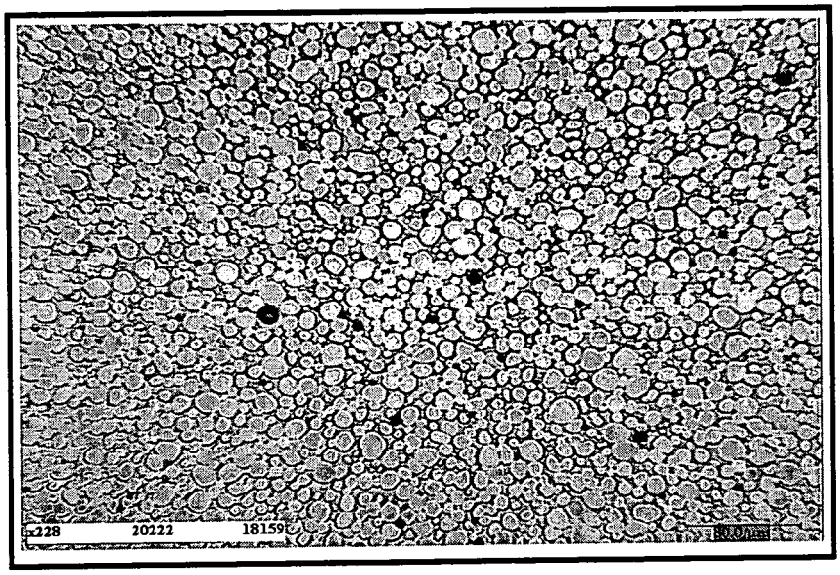
FIGS. 8 and 9 show micrographs of the microstructures of a third tungsten-based material sintered according to the invention.

In FIG. 8, which shows the micrograph of the material without any previous reduction processing, the material according to the invention and according to example 3 has the following characteristics: Vα=76.7%, Lα=8.2 μm, Cαα(%)=11.3%, λγ=2.5 μm.

Figure 9:
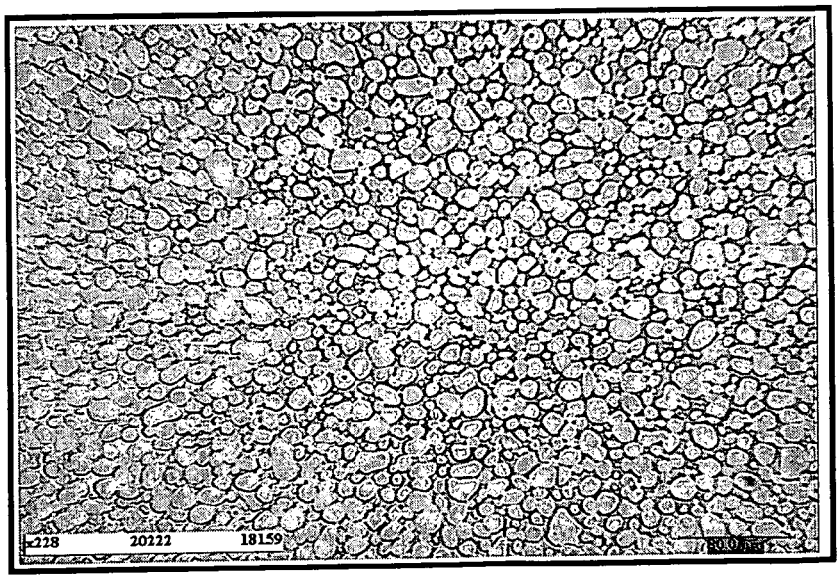

In FIG. 9, which shows the micrograph of the material having undergone reduction processing, the material according to example 3 has the following characteristics: Vα=78.7%, Lα=8.2 μm, Cαα(%)=12.2%, λγ=2.2 μm.

We observe therefore that with or without prior reduction processing, all of the morphology parameters have lower values and with an even lower reduction of the contiguity Cαα.

The process according to the invention thus enables all the morphology characteristics to be reduced for a material sintered using this process.

EXAMPLE 4

Figure 10:
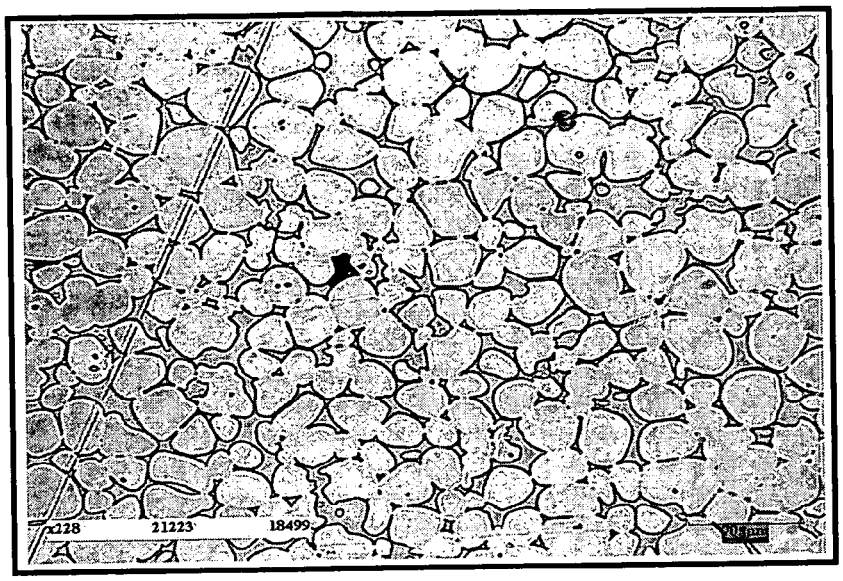
FIG. 10 shows a micrograph of the microstructures of a fourth tungsten-based material sintered conventionally according to prior art.

A bar is prepared from a W—Ni—Cu—Mn alloy (92.95, 5, 2, 0.05%) having a density of 17.6 by processing in the liquid phase according to the invention as explained previously:

geometry: cylinder ø 21, L=200 mm,
compression: $2.10^8$ Pa
sintering by induction in $N_2$,
time to reach T max 1450° C.: <6 mn
temperature build-up rate: δT/δt~420° C./mn,
time at 1450° C. stage: 3 mn (sintering time at liquid phase: <3 mn 30 s).

relative density: 100% (theoretical d: 17.85)
porosity: some
On a microstructural level, we observe:

In FIG. 10, we see a bar having the same composition but sintered according to prior art which has the following characteristics: Vα=84.7%, Lα=19.2 μm, Cαα(%)=20.1%, λγ=3.5 μm.

Figure 11:
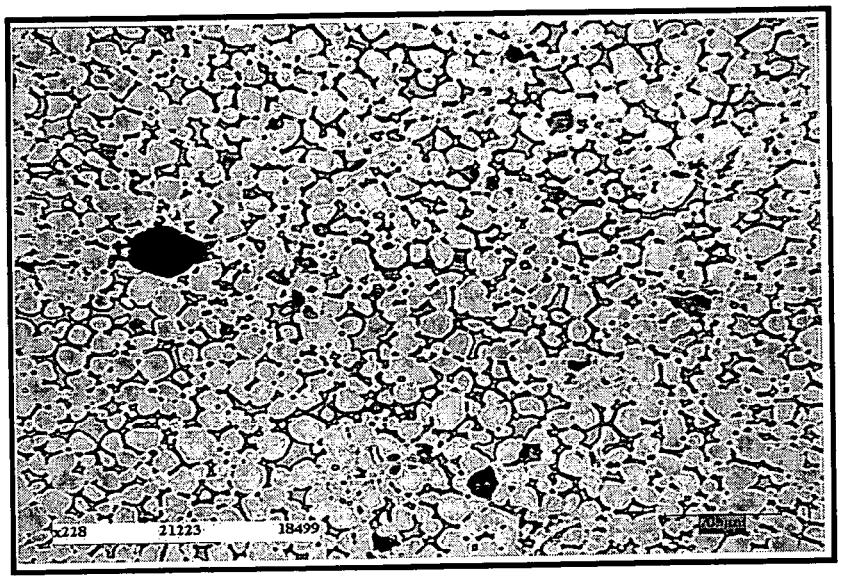
FIGS. 11 and 12 show micrographs of the microstructures of a fourth tungsten-based material sintered according to the invention.

In FIG. 11, which shows the micrograph of the material without any previous reduction processing, the material according to the invention and according to example 4 has the following characteristics: Vα=85.8%, Lα=10.6 μm, Cαα(%)=22.7%, λγ=1.8 μm.

Figure 12:
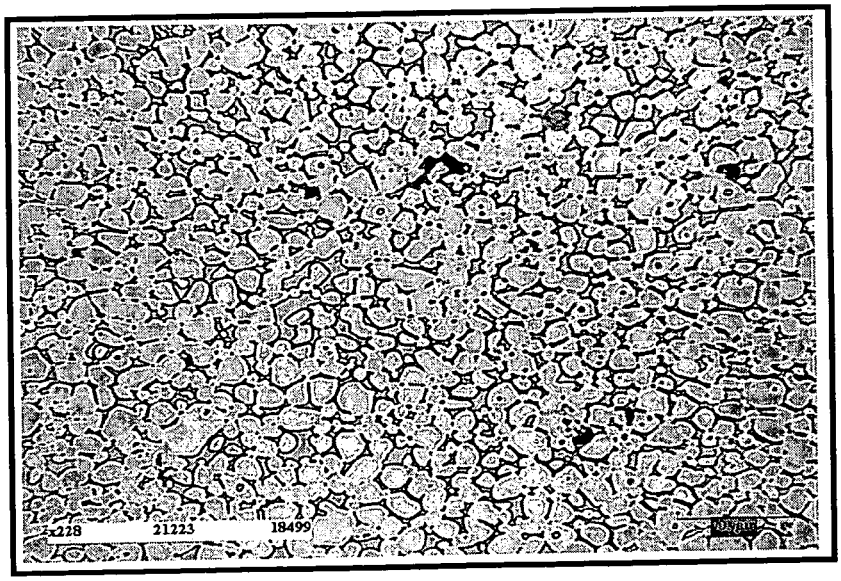

In FIG. 12, which shows the micrograph of the material having undergone reduction processing, the material according to example 4 has the following characteristics: Vα=85.3%, Lα=10.8 μm, Cαα(%)=21.3%, λγ=1.9 μm.

The porosities have a mean value of 10 μm in all cases.

We observe that Vα increases by subliming the liquid phase for the nickel-copper base and that La decreases with close contiguity Cαα.

For the four W-based chemical compositions, given by way of example, taking into account the alloy elements Ni, Fe, Cu, Co, Mn that are the most commonly used, we obtain:

1) Materials densified in a neutral, non reducing, atmosphere, with a total sintering time of less than 10 minutes; this compared with mean cycle times of 2 to 10 h in usual conditions, in hydrogen.
2) Homogeneously micro structured materials, with no porosities for the alloys of W—Ni—Fe—Co and W—Ni—Co systems, with a dispersion of micro-oxides if no prior reducing treatment has been performed.

Note that alloys of W—Ni—Cu—Mn tend to solidify with the presence of porosities.

Figure 13:
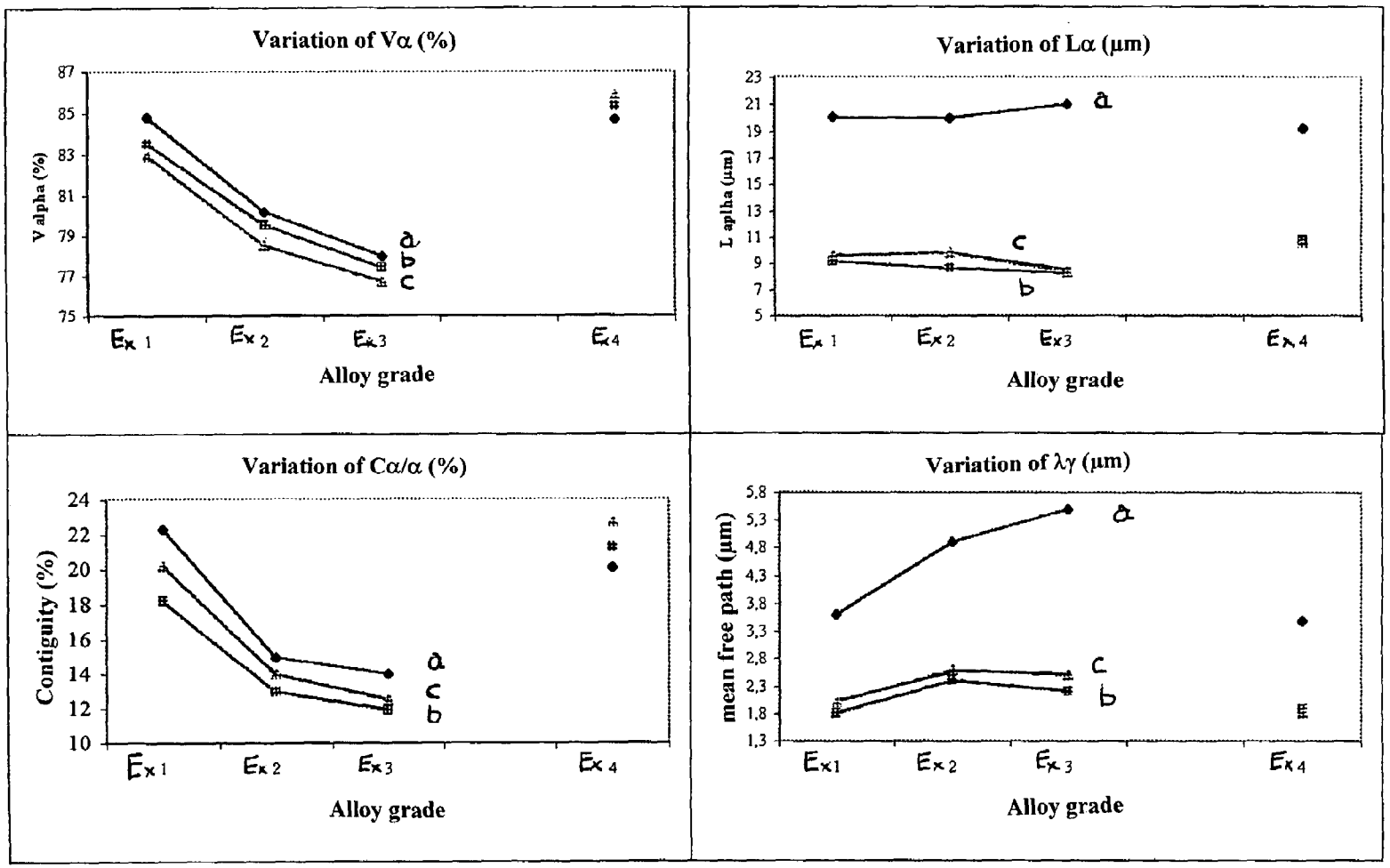
FIGS. 13 to 17 show the characteristics associated with such structures both from a morphological and mechanical perspective.

3) Materials whose microstructure is characterised by a mean nodule size of phase α(w) of between 8 and 12 μm, compared with 20 to 25 μm usually obtained.
4) Materials whose microstructure is generally characterised by a quite original morphology such as may be seen in FIG. 13.

Indeed, the principle on which the sintering of W—Ni—Fe—Co and W—Ni—Cu—Mn tungsten alloys is based lies in the maturing by nodulisation of the phase a(w) in a liquid Ni, Fe, Co, W or Ni, Cu, Mn, W at the maximal sintering temperature, which, after cooling, leads to a two-phased α-γ microstructure.

The relationship between morphology and mechanical characteristics will now be illustrated using tensile and resistance tests on four alloys previously made using the same composition, one alloy named FP prepared using long-lasting classical processes, one alloy named Pref+Ind prepared using the process according to the invention but whose sintering is carried out in a reducing atmosphere and one alloy named Ind prepared using the high power process according to the invention.

With reference to this FIG. 13, which illustrates the variation in microstructure according to the sintering process, the variation in Vα (%), Lα (μm), Cαα(%), and λγ (μm) have been shown according to the grade of alloy. Curve a corresponds to the compositions according to the examples 1 to 4 processed conventionally, curve b corresponds to the same compositions processed according to the invention but with a pre-sintering phase and curve c corresponds to the same compositions but processed according to the invention with no pre-sintering. The tungsten content of the phase γ surrounding the nodular phase α(w) depends on the composition of the alloy. We observe that the greater the tungsten's capacity to dissolve, the smaller the volume (Vα %) of phase a and the greater the mean free path (λγ) of this phase γ.

However, when sintering is performed at high power according to the invention (curve c), we observe that all the parameters describing the microstructure have lower values:

the volume of phase a (Vα %) is reduced, the nodule size α(Lα) and the mean free path of phase γ (λγ) are substantially reduced, the contiguity Cαα is also reduced.

Figure 14:
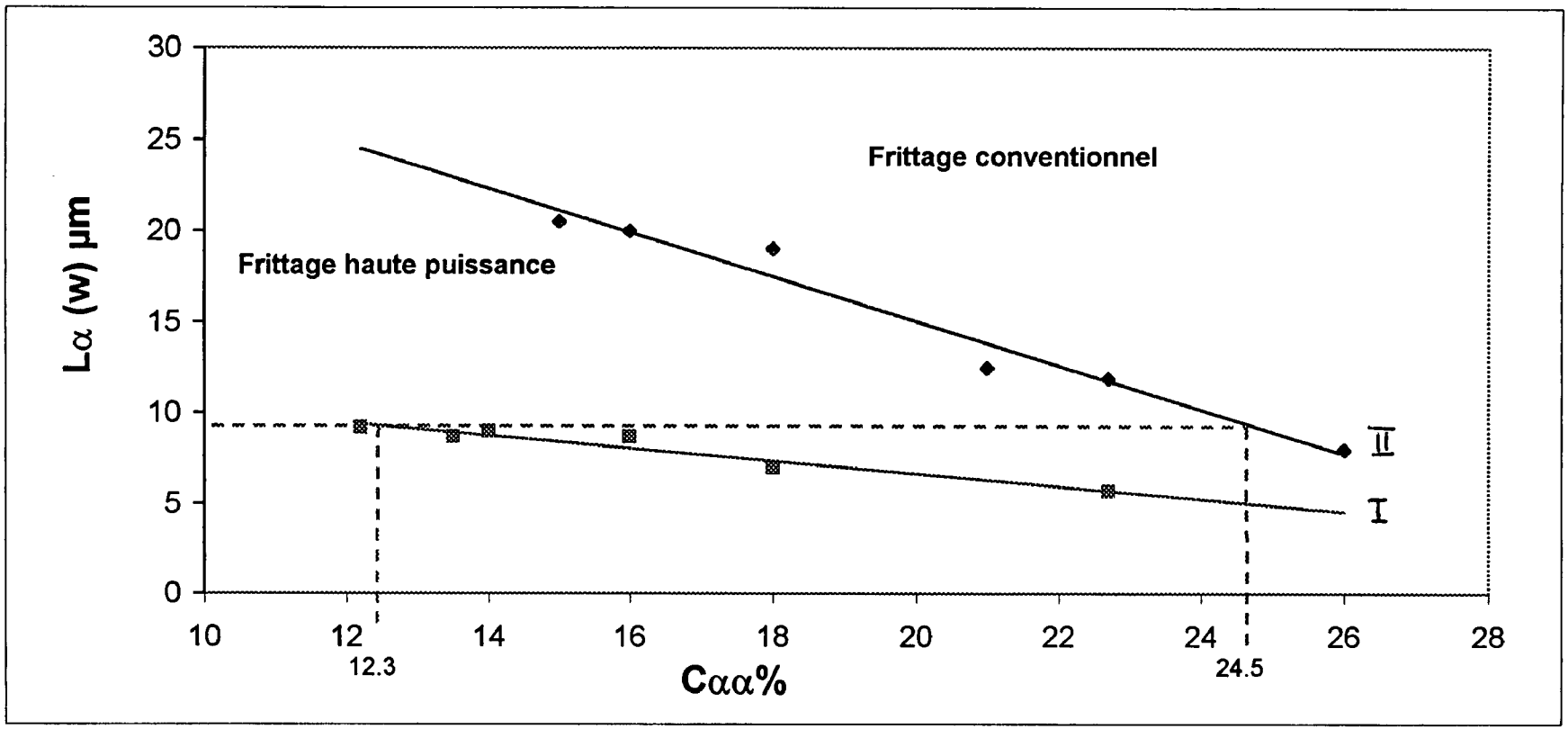

Moreover, as can be seen from curve I in FIG. 14, which illustrates the variation in nodule size Lα(W) of the W—Ni—Fe—Co alloy in example 2 according to the contiguity Cαα for a given sintering process, such a relation between the nodule size (Lα) in no way corresponds to the usual correlation between these parameters illustrated by curve II of the same alloy processed conventionally. Indeed, at the usual sintering power, when the nodule size α(Lα) decreases, the probability of contact Cαα(%) strongly increases.

At high power sintering conditions according to the invention, this increase in the probability of contact Cαα(%) is in fact much less (~3.5 times less).

Thus, as indicated in the example shown in this FIG. 14, for a same nodule size (Lα) of around 10 μm further to conventional sintering (curve II), and the other further to high power sintering according to the invention (curve I), the contiguity of the microstructure from the high power sintering is substantially reduced by a factor of around 2 (12.3% compared to 24.5%).

Figure 15:
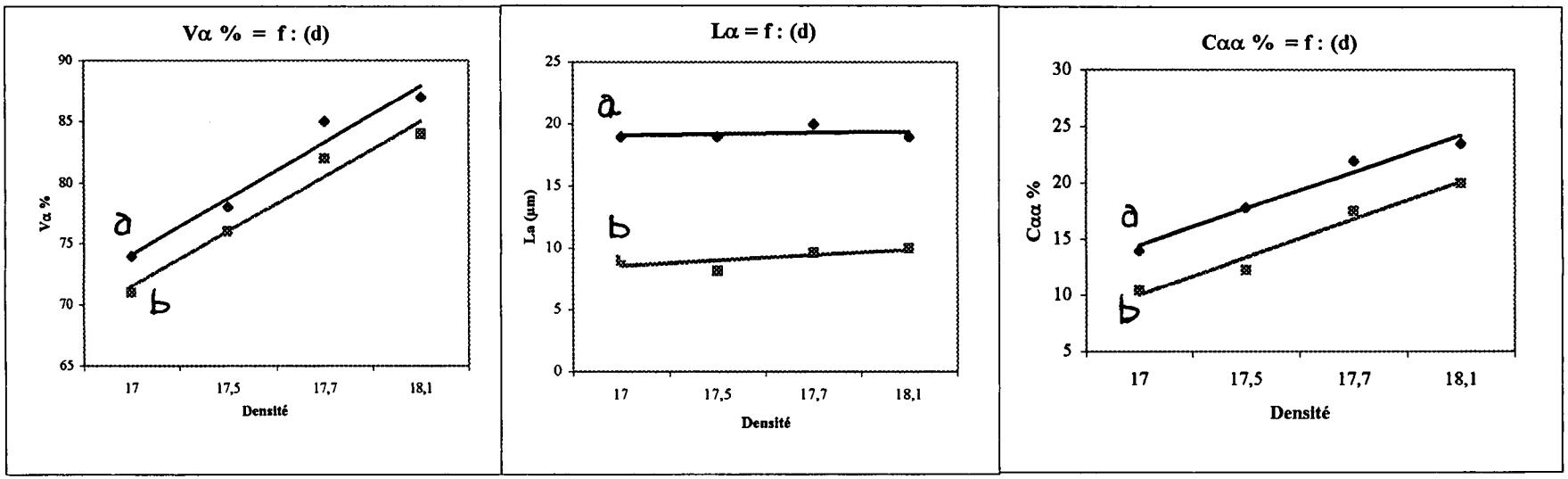

FIG. 15 illustrates the effect of the variation in the density of the alloy material according to example 2, by increasing the proportion of tungsten for a conventionally processed alloy (curve a) and for an alloy processed according to the invention (curve b).

As seen in FIG. 15, which illustrations the variations in Vα (%), Lα and Cαα(%) according to this density for a given sintering process for a W—Ni—Fe—Co alloy, we observe that the effect of this high power sintering according to the invention on the morphological parameters of the microstructure becomes generalised with the density of the alloy, which depends on the initial tungsten content of the alloy.

From the perspective of the mechanical properties of the alloys according to the invention in the sintered state and such as are measured by tensile or impact tests (Charpy test), these variations in morphology lead to trade-offs in characteristics that are particularly advantageous, at least for the W—Ni—Fe—Co and W—Ni—Co alloys that enable consolidations to be made with no porosities.

Figure 16:
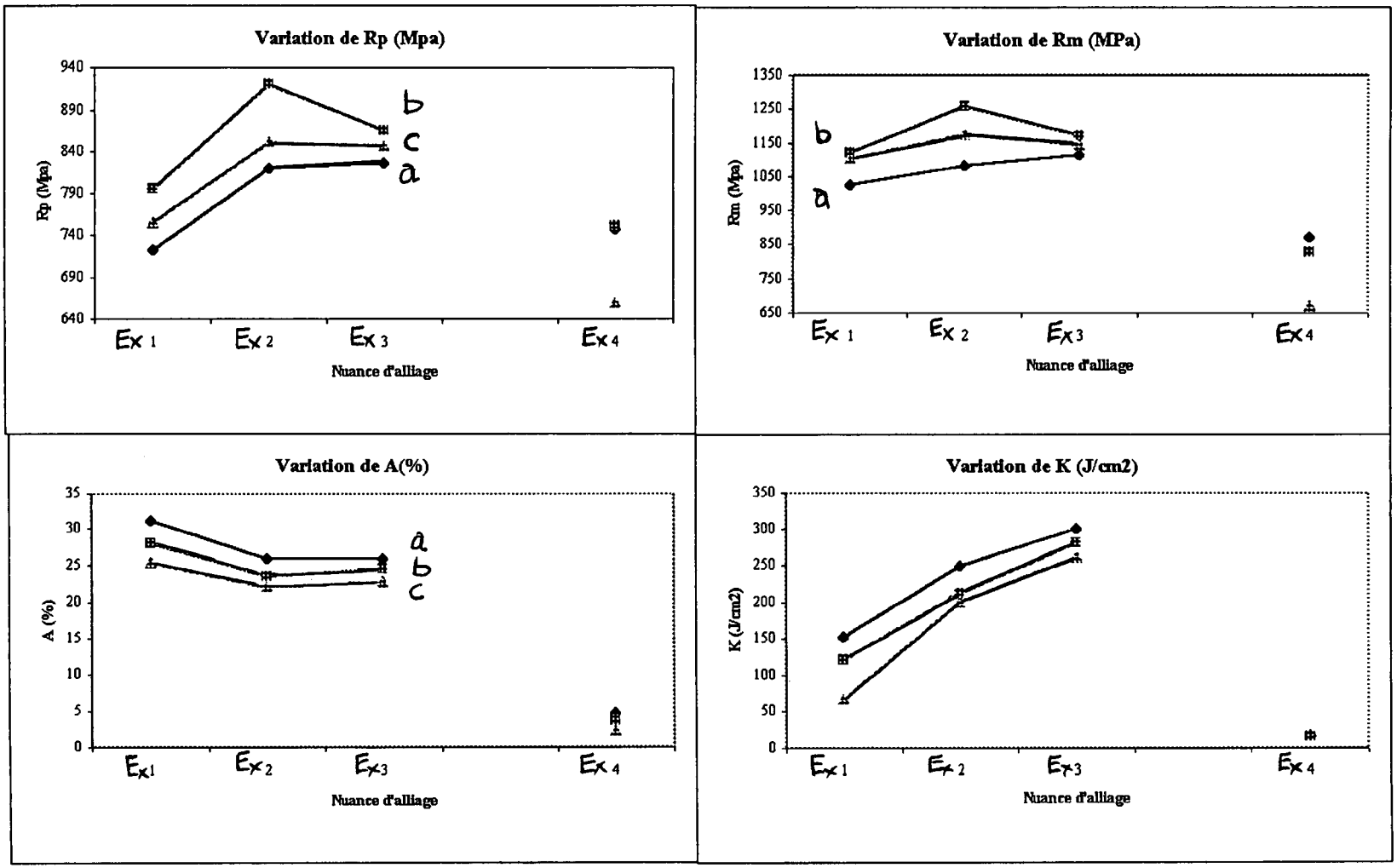

Curve (a) in FIG. 16 corresponds to the compositions according to examples 1 to 4 processed conventionally, curve (b) corresponds to the same compositions but processed according to the invention with a pre-sintering phase and curve c corresponds to the same compositions but processed according to the invention with no pre-sintering phase.

In FIG. 16, which shows the variation of the mechanical characteristic in the post-sintering state according to the sintering process used for alloys W—Ni—Fe—Co and W—Ni—Cu—Mn, the variation of Rp, Rm, A(%) and K(J/cm$^2$) are shown according to the alloy grade and according to the three types of sintering process explained previously; conventional, according to the invention with a reducing process and according to the invention without a reducing process. In a post-sintering state, after the usual thermal treatment of the annealing type, the characteristics recorded show that:

a. For a same alloy composition, it is possible for the tensile strength (Rp, Rm) to be increased without causing any great loss in ductility, both in traction (A%) and in impact (K), and this despite the presence of micro-oxides. In conventional processes, such an increase in tensile strength will involve the material having to undergo a rolling process.

b. For a same alloy and at identical high power sintering levels, the highest resistance-ductility trade-offs are obtained with those configurations having undergone prior deoxidising processing.

Having said that, for those products to be subjected to substantial mechanical stresses, such as for example tool holders, grinding spindle extensions, penetrators for kinetic ammunition, high levels of mechanical strength are required and obtained by rolling and annealing treatments.

Figure 17:
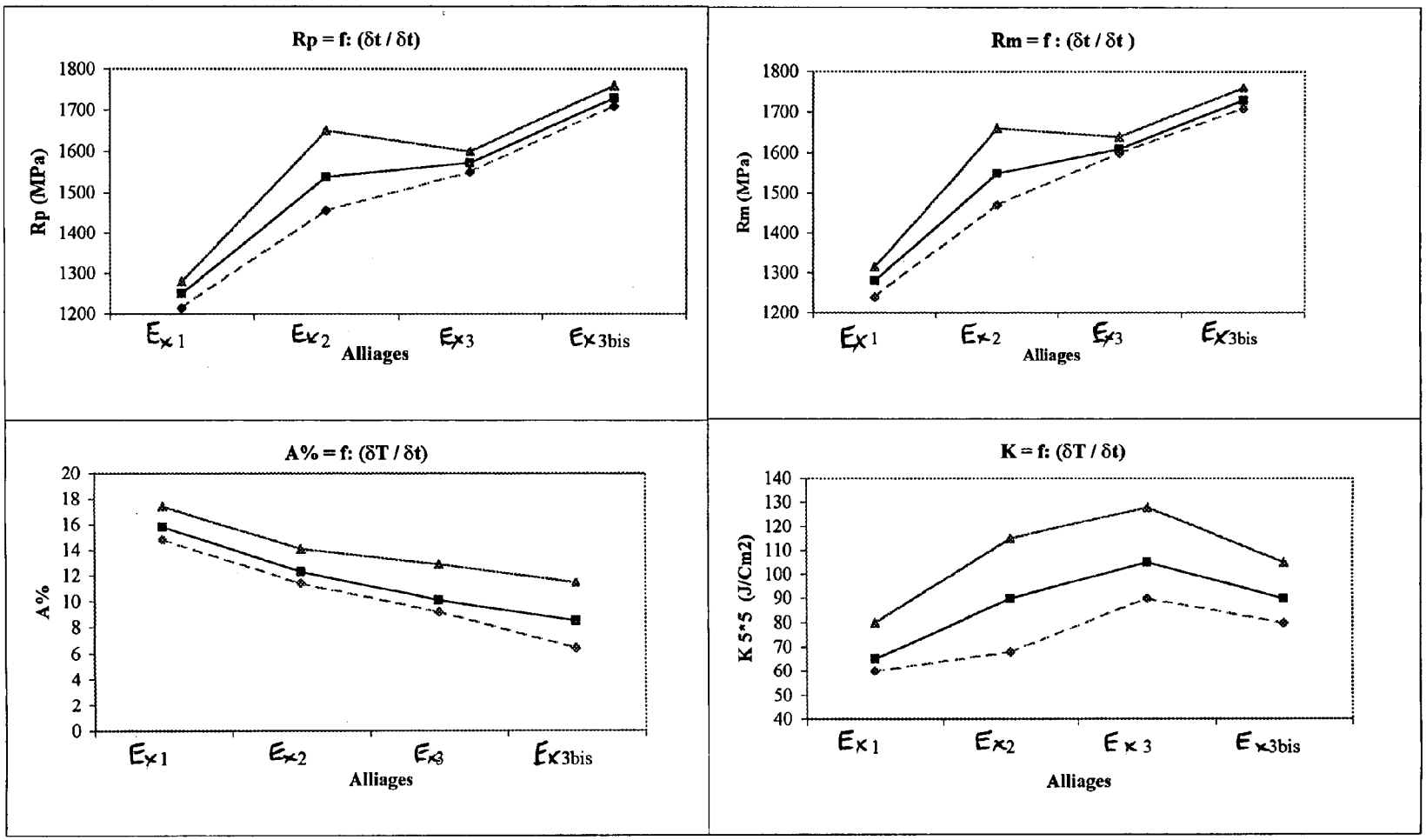

In FIG. 17, curve III relates to processing by conventional sintering, curve IV to sintering according to the invention and curve V to sintering according to the invention at double power.

FIG. 17 shows the variations in mechanical characteristics in the rolled annealed state according to the heating power during the sintering process for the W—Ni—Fe—Co alloy system, and with regard to this shows the advantages brought by prior high power sintering. Thus, in the example given for the three alloys according to examples 1 to 3 taken as a reference, using direct sintering with no prior deoxidisation (curves IV and V), it is apparent that according to three values of sintering power used ($\delta T/\delta t$):

a. the tensile strength characteristics (Rp and Rm) increase when the sintering power delivered also increases.

b. the ductility characteristics (A% and K) also increase, together with the tensile strength, which is an uncommon behaviour, c. moreover, the effect remains even when the rolling rate of the material increases, which corresponds to the point 3*b* is of the curves and which unequivocally demonstrates the additional effect brought about by the invention.

To sum up, high power sintering applied to materials from W—Ni—Cu, W—Ni—Co and W—Ni—Fe—Co alloy systems that may contain any other alloy element able to be dissolved in nickel, such as manganese, rhenium, molybdenum, chromium, tantalum, vanadium or niobium enables:

the usual sintering time to be considerably reduced, a full densification with no porosities to be obtained for alloys of the W—Ni—Fe—Co and W—Ni—CO system alloys, and with only small porosities for the W—Ni—Cu system alloy, which is to be expected, sintering to be carried out in a neutral argon or non-reducing nitrogen atmosphere, with the presence of a fine dispersion of oxides as a consequence. This is absent if a thermal deoxidisation treatment is carried out before sintering, materials to be obtained that have a quite unique microstructure for which not only the quantity and the size of nodules ($L\alpha$) of phase a are reduced, but also their contiguity ($C\alpha\alpha$%), a tensile strength-ductility (traction, impact) trade-off to be reached that is higher than may be obtained using conventional sintering; all the more so when the sintering power is high and the material has been rolled and thermally treated after sintering.

Note that it is known for tungsten-based nickel-copper alloys to have porosities. These are linked to complex chemical reaction mechanisms—local dissolution of the tungsten skeleton when the nickel copper phase passes into the liquid state during sintering and to competition between the variation in viscosity of the liquid phase and the local hydrostatic pressure of this liquid when passing into the solid state at the end of the sintering process.

What is claimed is:

1. Tungsten-based alloy material sintered at a high sintering power comprising tungsten, and additive elements soluble in nickel and selected from the group consisting of rhenium, molybdenum, tantalum, niobium, vanadium and mixtures thereof, wherein, after sintering in liquid phase at a temperature of around 1500° C., said temperature having been achieved in less than 15 minutes by raising the temperature by at least 100° C./minute and maintained for less than 15 minutes, said alloy material has:

a two-phased $\alpha$-$\gamma$ microstructure that is fully densified, has negligible porosities, and a low mean grain size ($L\alpha$) and a contiguity ($C\alpha\alpha$) that is very low with respect to the size of tungsten crystals in the alloy material, and a dispersion of micro-oxides for maintaining ductility.

2. Sintered material according to claim 1, wherein the percentage in mass of tungsten is between 85 and 97%.

3. Sintered material according to claim 1, of the following composition: 93% tungsten, 4.05% nickel, 1% iron and 1.95% cobalt, with a relative density of 100%.

4. Sintered material according to claim 1, of the following composition: 91% tungsten, 6.2% nickel, 0.3% iron and 2.5% cobalt, with a relative density of 100%.

5. Sintered material according to claim 1, of the following composition: 91% tungsten, 6% nickel and 3% cobalt, with a relative density of 100%.

6. Sintered material according to claim 1, of the following composition: 92.95% tungsten, 5% nickel, 2% copper and 0.05% manganese, with a relative density of 100%.

7. A process for preparing a tungsten-based alloy, comprising:

providing a mixture of metal powders comprising tungsten and one or more additive elements soluble in nickel and selected from the group consisting of rhenium, molybdenum, tantalum, niobium, vanadium, and mixtures thereof;

compressing the mixture at a pressure of around $2.10^8$Pa; and high power sintering the mixture in a liquid phase at a heating temperature of around 1500° C., achieving said temperature in less than 15 minutes by raising the temperature by at least 100° C./minutes and maintaining it for less than 15 minutes, to obtain a total densification and a structure with no porosities following a full cycle of less than 25 minutes.

8. Process for a material according to claim 7, wherein the heating temperature is obtained by induction in a neutral gas.

9. Preparation process for a material according to claim 8, wherein before sintering, a deoxidisation is carried out in $H_2$ at a temperature substantially greater than 1100° C. to obtain a full densification and a structure with no dispersion of oxide.

10. The process according to claim 8, wherein the neutral gas is selected from the group consisting of nitrogen and argon.

11. A penetrator for ammunition or tool holders made by the method of any one of claims 7–9.

12. Sintered material according to claim 2, wherein the percentage in mass of tungsten is between 90.5% and 93.5%.

13. A penetrator for ammunition or tool holders, comprising a tungsten based alloy material according to any of claims 1–6 and 12.

* * * * *

UNITED STATES PATENT AND TRADEMARK OFFICE

CERTIFICATE OF CORRECTION

PATENT NO. : 7,226,492 B2
APPLICATION NO. : 10/490962
DATED : June 5, 2007
INVENTOR(S) : Pascal Mahot et al.

It is certified that error appears in the above-identified patent and that said Letters Patent is hereby corrected as shown below:

Title Page should read -
(73) Assignee: CIME BOCUZE, La Roche Sur Foron (FR)

Signed and Sealed this

Tenth Day of November, 2009

David J. Kappos

David J. Kappos
*Director of the United States Patent and Trademark Office*